US009821934B2

(12) United States Patent
Bevan et al.

(10) Patent No.: US 9,821,934 B2
(45) Date of Patent: Nov. 21, 2017

(54) CLOSURE WITH FOLDED-UP TAMPER EVIDENT BAND

(75) Inventors: David Bevan, Ross-on-Wye (GB); Rodney Druitt, Cheltenham (GB)

(73) Assignee: CREANOVA UNIVERSAL CLOSURES LIMITED, Tewkesbury (GB)

( * ) Notice: Subject to any disclaimer, the term of this patent is extended or adjusted under 35 U.S.C. 154(b) by 0 days.

(21) Appl. No.: 14/005,337

(22) PCT Filed: Apr. 5, 2012

(86) PCT No.: PCT/AU2012/000349
§ 371 (c)(1),
(2), (4) Date: Dec. 9, 2013

(87) PCT Pub. No.: WO2012/135906
PCT Pub. Date: Oct. 11, 2012

(65) Prior Publication Data

US 2014/0190968 A1 Jul. 10, 2014

(30) Foreign Application Priority Data

Apr. 6, 2011 (AU) ..... 2011901276

(51) Int. Cl.
*B65D 41/34* (2006.01)
*B65D 41/32* (2006.01)

(52) U.S. Cl.
CPC ..... *B65D 41/32* (2013.01); *B65D 41/3428* (2013.01)

(58) Field of Classification Search
CPC ..... B65D 41/3428; B65D 41/3404
(Continued)

(56) References Cited

U.S. PATENT DOCUMENTS 5,570,798 A * 11/1996 Hayashida et al. ..... 215/252
5,727,705 A * 3/1998 Kelly ..... 215/252
(Continued)

FOREIGN PATENT DOCUMENTS

CL 201000871 2/2011
EP 0861792 9/1998
(Continued)

OTHER PUBLICATIONS

International Search Report for PCT/AU2012/000349.
(Continued)

*Primary Examiner* — J. Gregory Pickett
*Assistant Examiner* — Niki M Eloshway
(74) *Attorney, Agent, or Firm* — Caesar Rivise, PC

(57) ABSTRACT

A closure (10,30) attachable to a container having an opening. The closure (10,30) comprising a top portion (11) and a skirt portion (12) depending from the top portion (11). A tamper evident band (13,33) is joined to the skirt portion (12) by one or more frangible connectors (14,34). The band (13,33) comprises a first portion (15,35) extending generally away from the skirt portion (12) and a second portion (16,36) hingedly connected to the first portion (15,35) and movable between a first moldable orientation and at least a second operable orientation. For closure (10), the second portion (16) comprises a plurality of curved undercuts (18) extending at least partially into a cavity of the closure (10) when it is in its operable orientation. For closure (30), the inner surface (35*a*) of the first portion (35) can have a plurality of inwardly extending protuberances (40) positioned thereon.

13 Claims, 3 Drawing Sheets

(58) Field of Classification Search
USPC ..... 220/265; 215/252
See application file for complete search history.

(56) References Cited

U.S. PATENT DOCUMENTS

| | | | | |
|---|---|---|---|---|
| 5,755,527 | A * | 5/1998 | Dufresne | E01F 9/047 138/105 |
| 6,085,921 | A | 7/2000 | Brown | |
| 6,109,464 | A * | 8/2000 | Takano | 215/252 |
| 6,116,442 | A * | 9/2000 | Higgins | 215/252 |
| 6,484,896 | B2 * | 11/2002 | Ma | 215/252 |
| 6,581,792 | B1 * | 6/2003 | Limanjaya | B65D 41/3428 215/252 |
| 7,451,898 | B2 * | 11/2008 | Seidita | 222/253 |
| 8,650,839 | B1 * | 2/2014 | Robinson et al. | 53/412 |
| 2004/0045926 | A1 * | 3/2004 | Williamson | 215/252 |
| 2006/0163192 | A1 * | 7/2006 | Price et al. | 215/344 |
| 2006/0283829 | A1 | 12/2006 | Dubs et al. | |
| 2007/0090080 | A1 * | 4/2007 | Lohrman et al. | 215/305 |
| 2007/0181525 | A1 * | 8/2007 | Gregory et al. | 215/252 |

FOREIGN PATENT DOCUMENTS

| | | |
|---|---|---|
| EP | 1273524 | 5/2003 |
| ES | S2182223 | 3/2003 |
| JP | 09142505 | 6/1997 |
| WO | 1994002371 | 2/1994 |
| WO | WO 00/40473 | 7/2000 |
| WO | 2008104313 | 9/2008 |
| WO | WO 2009/101117 | 8/2009 |

OTHER PUBLICATIONS

Supplementary European Search Report for corresponding European Application No. EP 12 76 8044 dated Nov. 6, 2014.
Examination Report for corresponding Peruvian Patent Application No. 002194-2013/DIN, dated Jun. 23, 2017.
English Abstract of ES2182223.
Chilean Examination Report for corresponding Chilean Patent Application No. 201302841 dated Jan. 13, 2016.
English Abstract of CL200800555.
English Abstract for CL200401472.

* cited by examiner

CLOSURE WITH FOLDED-UP TAMPER EVIDENT BAND

CROSS REFERENCES TO RELATED APPLICATIONS

This utility application claims the benefit under 35 U.S.C. §371 of International Application PCT/AU2012/000349 filed on Apr. 5, 2012 which, in turn, takes its priority from Australian Patent Application Serial No. 2011901276 filed on Apr. 6, 2011, and all of whose entire disclosures are incorporated by reference herein.

FIELD OF THE INVENTION

The present invention relates to a closure having a tamper evident band.

BACKGROUND OF THE INVENTION

One type of closure, often known as a tamper evident closure, is designed to more readily indicate to a consumer or user that a container has previously been opened. The use of such closures can serve to reassure consumers that the contents of the container that they may be about to use or consume have not been accessed or otherwise adulterated prior to their use of the contents.

The manufacture of such closures presents challenges as such closures must often be capable of being relatively easy and cheap to make, be readily easy to apply to a container opening without being damaged, while also being very difficult if not impossible to remove from that container without some damage or change being caused to the closure that is indicative of removal or attempted removal.

Any discussion of documents, acts, materials, devices, articles or the like which has been included in the present specification is not to be taken as an admission that any or all of these matters form part of the prior art base or were common general knowledge in the field relevant to the present invention as it existed before the priority date of each claim of this application.

SUMMARY OF THE INVENTION

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

According to one aspect, the present invention is a closure attachable to a container having an opening, the closure comprising:

a top portion;

a skirt portion depending from the top portion, said top portion and skirt portion defining a cavity; and a tamper evident band joined to the skirt portion by one or more frangible connectors;

wherein the band comprises:

a first portion extending generally away from the skirt portion; and a second portion hingedly connected to the first portion and movable between a first moldable orientation and at least a second operable orientation;

the second portion comprising a plurality of curved undercuts extending at least partially into the cavity when in said operable orientation.

In one embodiment, the first portion of the band can be substantially annular and have an outer surface, an inner surface and a free end distal the skirt portion. The outer surface can at least in part be flared outwardly as it extends away from the skirt portion. The inner surface can at least in part be substantially cylindrical or cylindrical.

The second portion of the band can be hingedly connected to the first portion through a hinge connection. The hinge connection can be integrally formed at or adjacent the free end of the band. In one embodiment, the hinge connection can have at it or adjacent to it one or a plurality of slots or relatively thinned regions. A slot or thinned region can be provided in the hinge connection between two, between some, or between each of the curved undercuts. The hinge connection can be relatively thicker at the site of some or each of the curved undercuts.

The second portion can extend from the hinge connection to an inner edge. The inner edge can be suitable, once the band is in the operable orientation, to engage under a retaining flange on the container that is positioned appropriately relative the container opening and also once the closure has been attached to the container opening. The inner edge can have a chamfered inner corner.

In addition to the curved undercuts, the second portion can further comprise relatively thinned sections. In one embodiment, a thinned section can be integrally formed between two, between some, or between each of the curved undercuts. The thinned sections of the second portion can be formed to relatively assist in allowing the tamper evident band to flex.

One, some or all of the curved undercuts can comprise an inner wall and an outer wall and extend from the hinge connection to the inner edge. The inner wall can be convex. The outer wall can be concave. The inner edge can be curved. The curvature of the undercuts can be substantially spherical or spherical. One, some or each of the undercuts can have a substantially constant thickness. In another embodiment, the thickness of an undercut can vary. In one embodiment, an undercut can become gradually thicker moving relatively away from the hinge connection. Some or all of the undercuts can have a varying thickness, including an increasing thickness away from the hinge connection.

At least some, preferably the majority and even more preferably all of the second portion of the band is comprised of curved undercuts separated by the relatively thinned sections. In one example, the second portion can comprise between about 20 and about 25 curved undercuts, such as 22 curved undercuts.

According to a second aspect, the present invention is a closure attachable to a container having an opening, the closure comprising:

a top portion;

a skirt portion depending from the top portion, said top portion and skirt portion defining a cavity; and a tamper evident band joined to the skirt portion by one or more frangible connectors;

wherein the band comprises:

a first portion extending generally away from the skirt portion and having an inner surface; and a second portion hingedly connected to the first portion and movable between a first moldable orientation and at least a second operable orientation;

wherein the inner surface of the first portion has one or a plurality of inwardly extending protuberances.

In this aspect, the first portion of the band can be substantially annular and also have an outer surface and a free end distal the skirt portion. The outer surface can at least in part be flared outwardly as it extends away from the skirt portion. The inner surface can at least in part be substantially cylindrical or cylindrical.

The protuberances can be provided on the inner surface at or adjacent the free end of the first portion. In one embodiment, the protuberances can comprise band bumps. They can be spherical bumps. Where a plurality of protuberances are provided, the protuberances can be equally or non-equally spaced around the circumference of the inner surface. The protuberances can have an inwardly extending dimension that serves to ensure the second portion cannot collapse completely back against the inner surface of the first portion when the closure is attached to a container finish. The protuberances can assist in ensuring relatively inward pressure is applied on the second portion of the band when it is located under the retaining flange on a container and also during the opening action so ensuring the tamper evident band works to provide an indication to a user that the closure has been partially or wholly removed.

The second portion of the band can be hingedly connected to the first portion through a hinge connection. The hinge connection can be integrally formed at or adjacent the free end of the band. In one embodiment, the hinge connection can have at it or adjacent to it one or a plurality of slots or relatively thinned regions. A slot or thinned region can be provided in the hinge connection between two, between some, or between each of the curved undercuts. The hinge connection can be relatively thicker at the site of some or each of the curved undercuts.

The second portion can extend from the hinge connection to an inner edge. The inner edge can be suitable, once the band is in the operable orientation, to engage under a retaining flange on the container that is positioned appropriately relative the container opening and also once the closure has been attached to the container opening. The inner edge can have a chamfered inner corner.

The second portion can have a dimension extending from the hinge connection to the inner edge that can be greater than the longitudinal dimension of the protuberance(s). In one embodiment, the dimension of the second portion is approximately less than, equal to or about twice the longitudinal dimension of the protuberance(s). The relative longer dimension of the second portion compared to the longitudinal extent of the protuberance(s) can serve to allow the second portion to flex or bend around the protuberances during application of the closure to a container neck finish and particularly during application as the tamper evident band is moving over a retaining flange on the container neck.

While in this aspect, the second portion of the band can have a substantially uniform thickness, it will be appreciated that the second portion could have one or more curved undercuts extending at least partially into the cavity when the second portion is in the operable orientation.

In one embodiment of the aspects, the one or more frangible connectors can comprise frangible bridges. Where there are two or more frangible bridges, a gap can extend between the bridges. The frangible bridge(s) can connect an edge of the skirt portion distal the top portion to an upper end of the first portion of the tamper evident band.

The length of the one or more frangible bridges can set the gap, if any, between the distal edge of the skirt portion and the upper end of the tamper band first portion. The frangible bridges can further comprise a width and a thickness. The thickness and/or width of one, some or all of the frangible bridges can be the same over their length or can vary.

In the aspects, the skirt portion can depend from an outer edge of the top portion. An inner surface of the skirt portion can have a screw thread that is engageable with a corresponding thread on the end portion of the container to allow attachment of the closure to the container. Other complementary engagement mechanisms for attaching the closure can be envisaged, for example, a snap-on attachment arrangement. The screw thread on the closure can comprise a continuous or segmented screw thread.

An underside of the top portion in the aspects can be provided with one or more sealing ribs to engage and seal the opening of the container on attachment of the closure to the container. The one or more sealing ribs either alone or in combination can engage an inner surface, an end surface and/or an outer surface of the opening of a container. In another embodiment, the skirt portion can instead or also have a thickened region adjacent the connection with the top portion. The thickened region can have an inner surface, that can be cylindrical, that can seal against the outer surface of a container neck on attachment of the closure to a container.

In the aspects, the closure can be formed, for example in one piece. It can also be formed from a synthetic plastics material, such as a polyethylene or polypropylene.

In another aspect, the invention is a container/closure combination with the container having an opening sealed by a closure as defined herein.

In this aspect, the container can be a polyethylene terephthalate (PET) container.

In yet another aspect, the present invention is a mold for forming a closure as defined herein, the mold comprising a cavity shaped to form the tamper evident band with the second portion thereof in a molded orientation.

In this aspect, the mold can be used to form the closure using injection, rotary or compression molding.

In another aspect, the present invention comprises a method of forming a closure according to the first aspect comprising:

molding the closure with an integral tamper evident band, said second portion of the band being in a moldable orientation in which said curved undercuts extend outwardly; and re-orienting the second portion of the band relative to the first portion to a position wherein the curved undercuts extend into the cavity of the closure.

In this aspect, the re-orientation of the second portion of the band can occur prior to or during attachment of the closure to a container.

In yet another aspect, the present invention is a method of attaching a closure according to the first aspect to a container, the method comprising turning the closure onto the container until the closure seals the container and the curved undercuts are positioned under a retaining flange on the container.

In yet another aspect, the present invention comprises a method of forming a closure according to the second aspect comprising:

molding the closure with an integral tamper evident band, said second portion of the band being in a moldable orientation; and re-orienting the second portion of the band relative to the first portion to a position where it is adjacent the first portion.

In this aspect, the re-orientation of the second portion of the band can occur prior to or during attachment of the closure to a container.

In a still further aspect, the present invention is a method of attaching a closure according to the second aspect to a container, the method comprising turning the closure onto the container until the closure seals the container and the second portion is positioned under a retaining flange on the container.

BRIEF DESCRIPTION OF THE DRAWINGS

By way of example only, one embodiment of the invention is now described with reference to the accompanying drawings, in which.

PREFERRED MODE OF CARRYING OUT THE INVENTION

Figure 1:
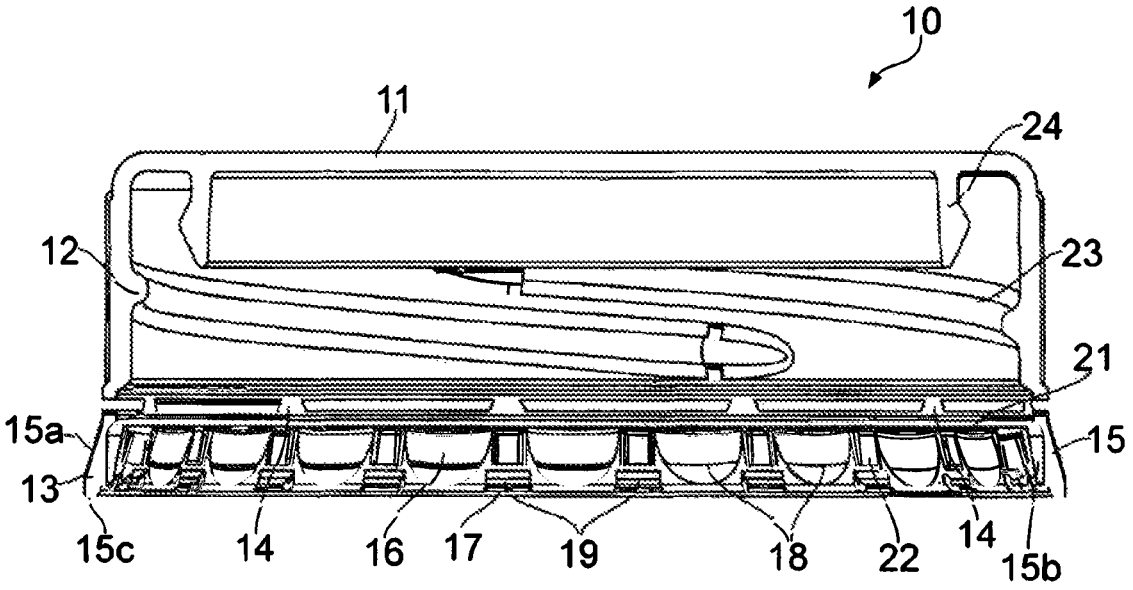
FIG. 1 is a cross-sectional view of one embodiment of the closure.
Figure 2:
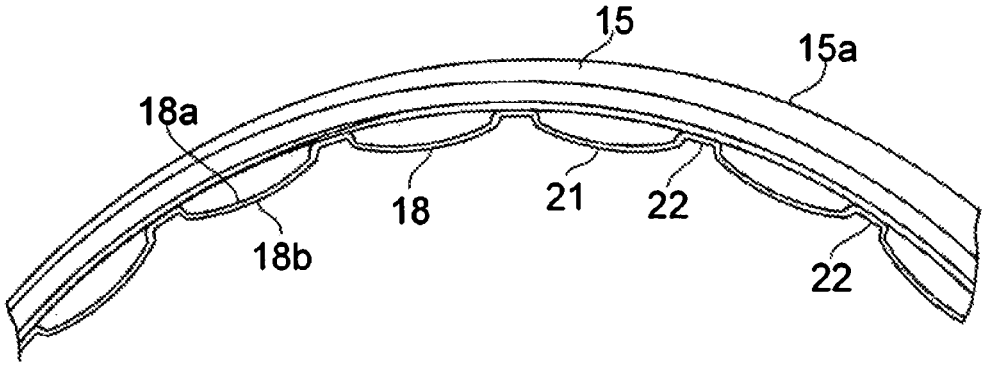
FIG. 2 is an enlarged partial top view of the tamper evident band portion of the closure of FIG. 1.
Figure 3:
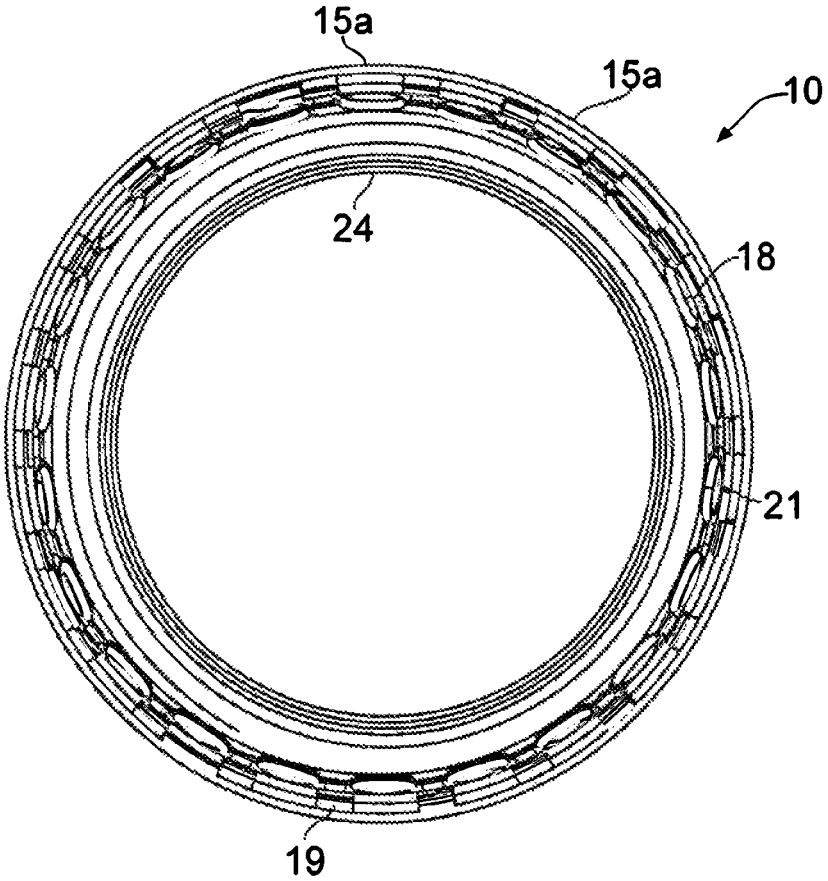
FIG. 3 is an underneath plan view of the closure of FIG. 1.
Figure 4B:
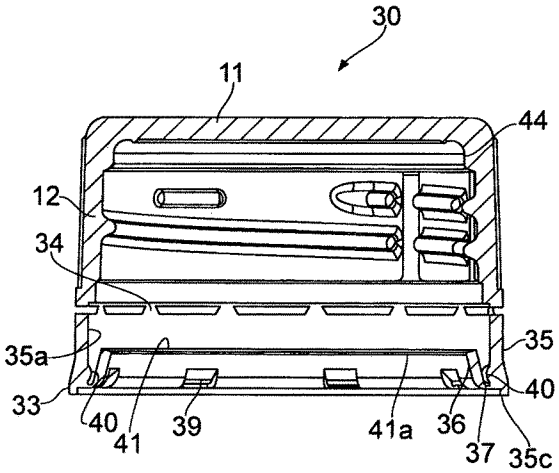
FIGS. 4*a* and 4*b* are cross-sectional views of another embodiment of a closure.
Figure 4A:
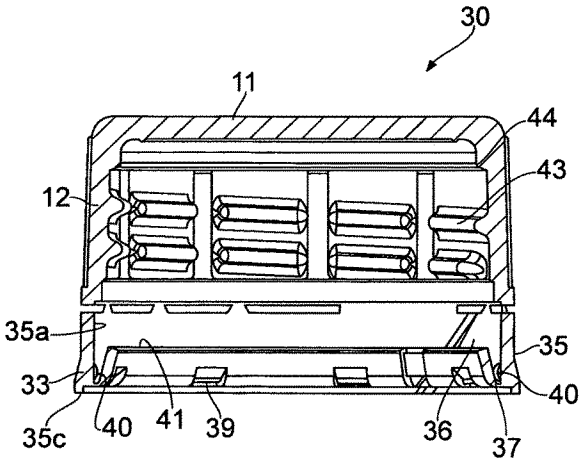

One example of a closure having features of the present invention is depicted generally as 10 in FIGS. 1 to 3. Another closure 30 is depicted in FIGS. 4*a* and 4*b*.

Both the closure 10 and closure 30 are suitable for capping or closing a container having an opening, for example, a PET beverage container. The closures 10,30 can be molded or otherwise formed, for example, in one piece from a synthetic plastics material, such as a polyethylene or polypropylene.

Both the closure 10 and closure 30 each comprise a top portion 11 and a skirt portion 12 depending from an outer edge of the top portion 11. The top portion 11 and skirt portion 12 together define a cavity that relatively receives the opening of the container.

For closure 10, a tamper evident band 13 is joined to the skirt portion 12 by a plurality of frangible bridges 14. Embodiments having fewer or a greater number of bridges than depicted can be envisaged. At least a portion of the tamper evident band 13 (as described below) is adapted to be retained under a retaining flange on the container following capping so that one or more of the frangible bridges 14 are partially or wholly severed on any attempt to remove the closure 10 from the container.

The tamper evident band 13 comprises a first portion 15 extending generally away from the skirt portion 12 and a second portion 16 hingedly connected through a hinge connection 17 to the first portion 15.

The first portion 15 of the band 13 is substantially annular and has an outer surface 15*a*, an inner surface 15*b* and a free end 15*c* distal the skirt portion 12. As depicted, the outer surface 15*a* can at least in part be flared outwardly away from the skirt portion 12 while the inner surface 15*b* can at least in part be substantially cylindrical or cylindrical.

The second portion 16 is movable relative the first portion 15 between a first moldable orientation (not depicted) in which the second portion 16 has not been folded up into the cavity of the closure 10 and at least a second operable orientation (which is depicted in FIG. 1).

In the second operable orientation and as depicted in FIG. 1, a plurality of curved undercuts 18 that partially make up the band 13, extend at least partially into the cavity of the closure 10.

The depicted hinge connection 17 is integrally formed at or adjacent the free end 15*c* of the first portion 15 of the band 13. At the hinge connection 17 there is provided a plurality of slots 19. Rather than slots, it will be appreciated that there could be provided a plurality of relatively thinned regions. In the embodiment depicted in FIG. 1, a slot 19 is provided at the hinge connection 17 between each of the curved undercuts 18. As depicted, the hinge connection 17 can be relatively thicker at the site of each of the curved undercuts 18.

The second portion 16 extends from the hinge connection 17 to an inner edge 21. The inner edge is suitable to engage under a retaining flange on the container that is positioned appropriately relative the container opening once the closure has been attached to the container opening. The inner edge 21 can have a chamfered inner corner.

In addition to the curved undercuts 18, the second portion 16 also comprises relatively thinned sections 22. Each thinned section 22 is integrally formed between each of the curved undercuts 18 and assist in allowing the band 13 to flex.

As depicted best in FIG. 2, each of the curved undercuts 18 comprises a concave outer wall 18*a* and a convex inner wall 18*b* (when in the operable orientation). The curvature of the undercuts 18 is substantially spherical or spherical. As depicted, each undercut 18 can have a substantially constant thickness, however, it will be appreciated that the thickness of one, some or all of the undercuts 18 could vary, for example by getting gradually thicker moving relatively away from the hinge connection 17. As depicted, the second portion 16 can comprise 22 curved undercuts, however, it will be appreciated that other numbers of undercuts can be provided.

Turning to the closure 30 depicted in FIGS. 4*a* and 4*b*, it comprises a tamper evident band 33 having a first portion 35 extending generally away from the skirt portion 12 and having a substantially cylindrical inner surface 35*a*. A second portion 36 is hingedly connected to the first portion 35 and is movable between a first moldable orientation (not depicted) and at least a second operable orientation (as is depicted in FIGS. 4*a* and 4*b*). The tamper evident band 33 is joined to the skirt portion 12 by a plurality of frangible bridges 34. Embodiments having fewer or a greater number of bridges than depicted can be envisaged.

As depicted, the inner surface 35*a* of the first portion 35 has a plurality of inwardly extending protuberances 40. The protuberances 40 are provided on the inner surface 35*a* at a free end 35*c* of the first portion 35. In the depicted embodiment, the protuberances 40 comprise hemispherical band bumps and are substantially equally spaced around the circumference of the inner surface 35*a*.

The protuberances 40 have an inwardly extending dimension that serves to ensure the second portion 36 cannot collapse completely back against the inner surface 35*a* of the first portion 35 when the closure 30 is attached to a container finish. The protuberances 40 also assist in ensuring relatively inward pressure is applied on the second portion 36 of the band 33 when it is located under the retaining flange on a container and also during the opening action so ensuring the tamper evident band 33 works to provide an indication to a user that the closure 30 has been partially or wholly removed.

The second portion 36 of the band is hingedly connected to the first portion 35 through a hinge connection 37. The hinge connection 37 is integrally formed adjacent the free end 35*c* of the band. A series of slots 39 are also provided.

The second portion 36 extends from the hinge connection 37 to an inner edge 41. The inner edge 41 is suitable, once the band 33 is in the operable orientation, to engage under a retaining flange on the container that is positioned appropriately relative the container opening and also once the closure 30 has been attached to the container opening. The inner edge can have a chamfered inner corner 41*a*.

The second portion 36 has a dimension extending from the hinge connection 37 to the inner edge 41 that is greater than the longitudinal dimension of the protuberances 40. In the depicted embodiment, the dimension of the second portion 36 is approximately twice the longitudinal dimension of the protuberances 40. The relative longer dimension of the second portion 36 compared to the longitudinal extent of the protuberances 40 serves to allow the second portion 36 to flex or bend around the protuberances 40 during application of the closure 30 to a container neck finish and particularly during application as the tamper evident band 33 is moving over a retaining flange on the container neck.

As depicted for closure 10, an inner surface of the skirt portion 12 can have a screw thread 23 that is engageable with a corresponding thread on the end portion of the container to allow attachment of the closure 10 to the container. It will be noted that closure 30 also has a screw thread 43. Other complementary engagement mechanisms for attaching the closure can be envisaged, for example, a snap-on attachment arrangement. While a continuous screw thread 23 is depicted, for closure 10, the thread can comprise a segmented screw thread as is depicted for closure 30.

For closure 10, an underside of the top portion 11 can be provided with a sealing rib 24 to engage and seal the opening of the container on attachment of the closure 10 to the container. Other arrangements of sealing rib to that depicted can be used on the closure 10. For closure 30, it will be noted that there is a thickening 44 in the skirt portion 12 at the connection of the skirt portion to the top portion 11. The thickening can serve to seal against an outer surface of a container neck finish.

While not depicted, the closures 10,30 can be used to cap a container and so form a container/closure combination with the container having an opening sealed by a closure 10,30 as depicted.

A mold can be used to form the closures 10,30. The mold can comprise a cavity shaped to form the tamper evident band 13,33 with the second portion 16,36 thereof initially in a molded orientation, ie folded downwards in contrast to the orientation depicted. The mold can be used to form the closure using injection, rotary or compression molding.

The method of forming the closure 10 can comprise:

molding the closure 10 with an integral tamper evident band 13, with the second portion 16 of the band 13 being at least initially in a moldable orientation in which the curved undercuts 18 extend outwardly; and re-orienting the second portion 16 of the band 13 relative to the first portion 15 to a position (as depicted in FIG. 1) wherein the curved undercuts 18 extend into the cavity of the closure 10.

In this method, the re-orientation of the second portion 16 of the band 13 can occur prior to or during attachment of the closure 10 to a container.

A method of attaching the closure 10 to a container can comprise turning the closure 10 onto the container until the closure seals the container and the curved undercuts 18 are positioned under a retaining flange on the container. When the contents of the container need to be accessed, a user can assess the integrity of the band 13 and if there is no evidence of tamper feel relatively confident to unscrew the closure 10 from the container and use or consume the contents.

The method of forming the closure 30 can comprise:

molding the closure 30 with an integral tamper evident band 33, with the second portion 36 of the band 33 being at least initially in a moldable orientation; and re-orienting the second portion 36 of the band 33 relative to the first portion 35 to a position (as depicted in FIGS. 4*a* and 4*b*).

In this method, the re-orientation of the second portion 36 of the band 33 can occur prior to or during attachment of the closure 30 to a container.

A method of attaching the closure 30 to a container can comprise turning the closure 30 onto the container until the closure seals the container and the free end 41 of the second portion 36 is positioned under a retaining flange on the container. When the contents of the container need to be accessed, a user can assess the integrity of the band 33 and if there is no evidence of tamper feel relatively confident to unscrew the closure 30 from the container and use or consume the contents.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A closure attachable to a container having an opening, the closure comprising:

a top portion;

a skirt portion depending from the top portion, said top portion and skirt portion defining a cavity; and a tamper evident band joined to the skirt portion by one or more frangible connectors;

wherein the band comprises:

a first portion extending generally away from the skirt portion and having a free edge and an inner surface; and a second portion hingedly connected to the first portion through a hinge connection adjacent the free edge, said second portion being movable between a first moldable orientation and at least a second operable orientation;

wherein the first portion has a plurality of inwardly extending protuberances on the inner surface at the hinge connection;

wherein the second portion has a dimension extending from the hinge connection to an inner edge that is greater than the longitudinal dimension of the protuberances;

wherein a plurality of slots are provided in the second portion at the hinge connection;

and further wherein the plurality of inwardly extending protuberances have an inwardly extending dimension that serves to ensure the second portion cannot collapse completely back against the inner surface of the first portion when the closure is attached to a container finish enabling gas to vent from the container via the plurality of slots upon removal of the closure from the container.

2. The closure of claim 1 comprising a plurality of equally spaced protuberances.

3. The closure of claim 1 wherein the dimension of the second portion is approximately equal to twice the longitudinal dimension of the protuberances.

4. The closure of claim 1 wherein the one or more frangible connectors comprise frangible bridges.

5. A container/closure combination with the container having an opening sealed by a closure as defined by claim 1.

6. A mold for forming a closure as defined in claim 1, the mold comprising a cavity shaped to form the tamper evident band with the second portion thereof in a molded orientation.

7. A method of forming a closure according to claim 1 comprising:

molding the closure with an integral tamper evident band, said second portion of the band being in a moldable orientation; and re-orienting the second portion of the band relative to the first portion to a position where it is adjacent the first portion.

8. A method of attaching a closure according to claim 1 to a container, the method comprising turning the closure onto the container until the closure seals the container and the second portion is positioned under a retaining flange on the container.

9. The closure of claim 1 wherein the second portion comprises:

a plurality of separate curved undercuts extending at least partially into the cavity when in said operable orientation, each undercut being hingedly connected to the first portion through the hinge connection; and relatively thinned sections integrally formed between the opposing ends of each of the curved undercuts, each thinned section defining a slot between the thinned section and the free end of said first portion.

10. The closure of claim 9 wherein one, some or all of the curved undercuts comprise an inner wall and an outer wall and extend from the hinge connection to the inner edge.

11. The closure of claim 10 wherein the inner wall is convex and the outer wall is concave.

12. The closure of claim 9 wherein the number of protuberances matches the number of curved undercuts.

13. A closure attachable to a container having an opening, the closure comprising:

a top portion;

a skirt portion depending from the top portion, said top portion and skirt portion defining a cavity; and a tamper evident band joined to the skirt portion by one or more frangible connectors;

wherein the band comprises:

a first portion extending generally away from the skirt portion and having a free end and an inner surface, the first portion having a plurality of inwardly extending protuberances on the inner surface at the free end; and a second portion hingedly connected to the first portion through a hinge connection adjacent the free end, said second portion being movable between a first moldable orientation and at least a second operable orientation;

wherein the first portion has a plurality of inwardly extending protuberances on the inner surface at the hinge connection;

wherein the second portion has a dimension extending from the hinge connection to an inner edge that is greater than the longitudinal dimension of the protuberances;

wherein the protuberances are hemispherical bumps;

wherein a plurality of slots are provided in the second portion at the hinge connection;

and further wherein the plurality of inwardly extending protuberances have an inwardly extending dimension that serves to ensure the second portion cannot collapse completely back against the inner surface of the first portion when the closure is attached to a container finish enabling gas to vent from the container via the plurality of slots upon removal of the closure from the container.

* * * * *